US006116307A

United States Patent [19]

Mangigian et al.

[11] Patent Number: 6,116,307

[45] Date of Patent: Sep. 12, 2000

[54] GOLF CLUB COVER

[76] Inventors: George Mangigian, 49 Tanguy Rd., Glen Mills, Pa. 19342; Albert Balukas, 5170 W. Chester Pike, Newtown Square, Pa. 19073

[21] Appl. No.: 09/200,426

[22] Filed: Nov. 25, 1998

[51] Int. Cl.[7] ..... A63B 57/00

[52] U.S. Cl. ..... 150/160; 206/315.4

[58] Field of Search ..... 150/159, 160; 206/315.2, 315.4

[56] References Cited

U.S. PATENT DOCUMENTS

| | | | |
|---|---|---|---|
| 2,508,525 | 5/1950 | Le Fevre | 150/160 |
| 2,705,039 | 3/1955 | Halter | 150/160 |
| 3,117,609 | 1/1964 | Pio | 150/160 |
| 3,593,769 | 7/1971 | Spears | 150/160 |
| 3,613,760 | 10/1971 | Koehnle | 150/160 |
| 3,664,399 | 5/1972 | Neff | 150/160 |
| 3,892,267 | 7/1975 | Bibeau | 150/160 |
| 4,119,129 | 10/1978 | Freiberg | 150/160 |
| 4,195,677 | 4/1980 | Hagg et al. | 150/160 |
| 4,378,832 | 4/1983 | Thompson | 150/160 |
| 5,000,238 | 3/1991 | Zeller | 150/160 |
| 5,050,655 | 9/1991 | Borenstein | 150/160 |

FOREIGN PATENT DOCUMENTS

| | | | |
|---|---|---|---|
| 383013 | 11/1932 | United Kingdom | 150/160 |
| 1397277 | 6/1975 | United Kingdom | 150/160 |

*Primary Examiner*—Sue A. Weaver
*Attorney, Agent, or Firm*—Jeffrey C. Lew

[57] ABSTRACT

A cover for the head of a golf club, especially a putter, has a pair of elongated jaws which each have a C-shape profile viewed perpendicular to the axis of jaw elongation. The jaws face each other to define an interior, open ended, tubular cavity adapted to accept the head of the putter. A handle is attached to each jaw cooperatively forming a V-shaped orientation at adjacent top jaw edges. The jaws are pivotally connected proximate the handles and a manually releasable spring cooperates with the pivotal connector to urge the bottom edges of the opposing jaws toward each other in a normally closed position of the cover about the club head. The jaws are lined inside the cavity with a soft, resilient material adapted to firmly grip and cushion the head against potential impact damage. The cover is suitable for many different club head shapes. Also, the jaws have linear bottom edges which adapt the cover to T style, L style and intermediate shaft-to-head connection point putters.

The cover is quickly and easily deployed onto the head of a club and can be conveniently clamped temporarily to a golf cart or bag which prevents losing the cover while the club is played.

17 Claims, 3 Drawing Sheets

GOLF CLUB COVER

FIELD OF THE INVENTION

This invention relates to golf club covers and more specifically relates to removable golf club head covers.

BACKGROUND AND SUMMARY OF THE INVENTION

Golf club covers historically have been found very useful for protecting club heads from dirt, damage due to accidental impact with other clubs or objects, and adverse environmental effects, such as exposure to sun and rain. Stocking cap type covers have been available for a long time. These are typically made of fabric and generally have a sleeve that slides over the head and extends a short distance along the shaft. Although functional and inexpensive stocking cap covers are inconvenient to use in that they are easily lost when removed from a club and take considerable time to replace on the club. Proper use of stocking cap covers thus delays progress of the game which detracts from the enjoyment of the players.

A variety of fixed shape golf club covers have been disclosed in the art. Examples include club covers disclosed in U.S. Pat. Nos. 2,508,525; 3,117,609; 3,664,399; and 4,278,832. These covers primarily are intended for protecting wooden head clubs which are most susceptible to damage. U.S. Pat. No. 5,050,655 discloses a fixed shape head cover for a metal head club (i.e., an iron). These fixed shape covers commonly feature near complete encapsulation of the head to protect against intrusion of foreign matter as well as against impact damage. Due lo the variety of club shapes, fixed shape covers either must be fitted to a particular club or be oversized to accept the largest in a selection of clubs. Either way, the covers occupy a large volume, are somewhat cumbersome and are inconvenient for temporary storage while the club is in use.

Despite the extensive historical development of golf club accessories, there remains a need for a golf club cover especially adapted for protection of the putter. Modern putters are normally made of metal, including often expensive alloys. They are used for strokes which demand utmost in precision of projecting the ball upon impact with the club. Therefore maintaining cleanliness and freedom from nicks, dents and scratches, particularly on the club face, is extremely important.

Putters usually have an elongated, narrow head with a flat face aligned perpendicular to the ground surface. A variety of styles have evolved. These include "T" and "L" styles. The shaft of the T style connects to about the center of the head. In the L style, the shaft connects near one end of the head. Variations exist in which the shaft connects to the head at positions intermediate the center and the end of the head. It is desirable to have a cover which can accommodate the many geometric configurations of modern putters.

Additionally, there is a current need for a golf club cover which is quick to remove, easy and convenient to store temporarily while the club is in use, and simple and fast to replace.

Accordingly, there is now provided a cover for the head of a golf club comprising a pair of elongated jaws which define an axis of elongation, each jaw having a C-shaped profile perpendicular to the axis to define an open ended, tubular cavity, a top edge, and a bottom edge diametrically across the cavity from the top edge;

means for pivotally connecting the jaws at the top edges;

a handle affixed to each jaw, which handles are aligned in relation to each other in a V-shape orientation; and manually releasable spring means for urging the bottom edges toward each other in a normally closed position of the cover about the head of the club In an embodiment, at least the interior of the club cover is provided with a layer of soft, resilient material.

DETAILED DESCRIPTION

Figure 1:
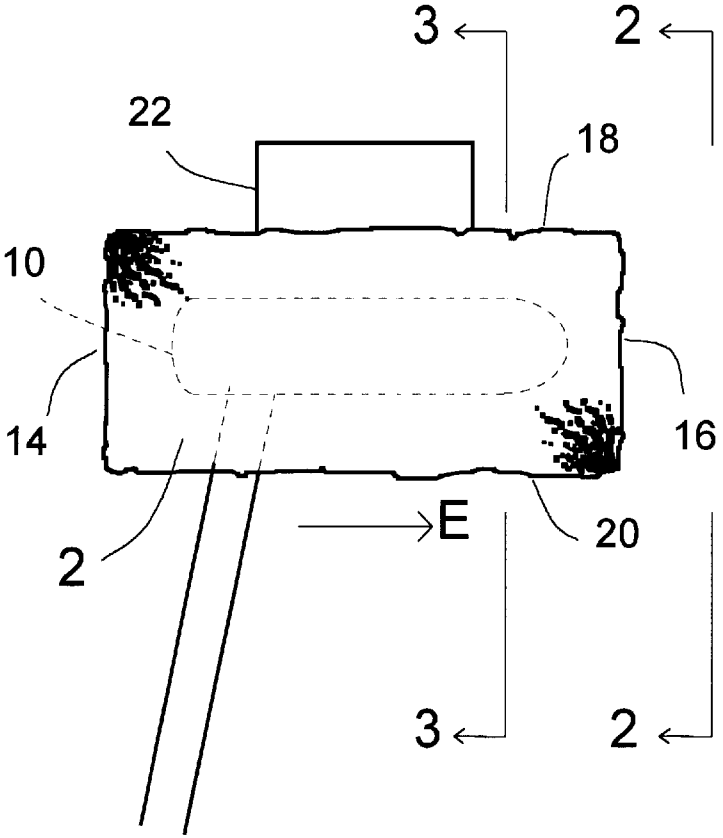
FIG. 1 is a side elevation view of a golf club cover deployed on a putter according to this invention.
Figure 2:
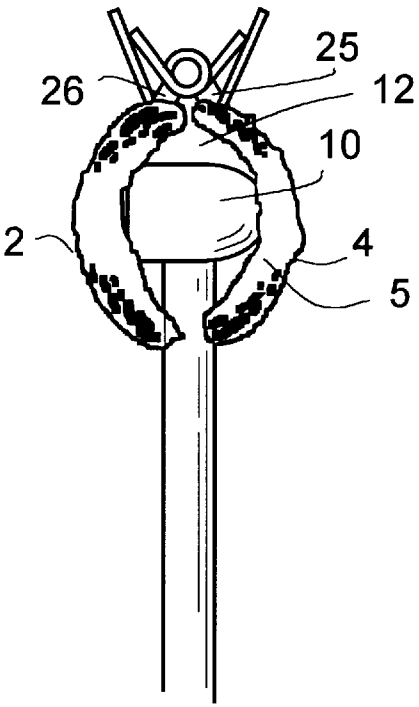
FIG. 2 is an end view of the golf club cover of FIG. 1 taken along line 2—2.
Figure 3:
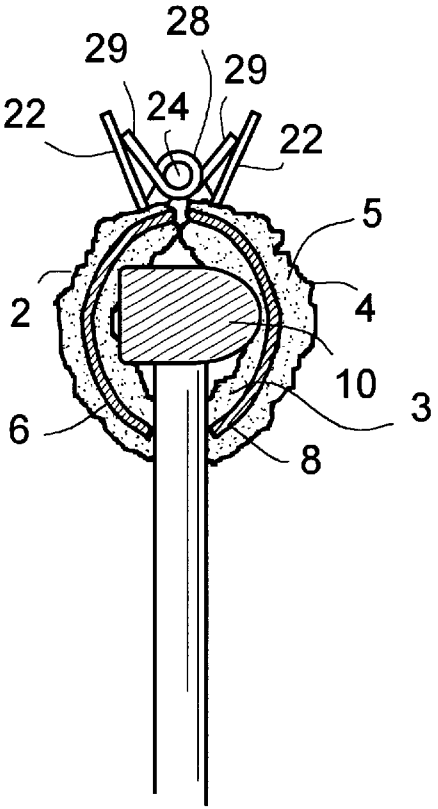
FIG. 3 is a section view of the golf club cover of FIG. 1 taken along line 3—3.

As shown in FIGS. 1–3 in which the same parts are given the same reference numbers, the novel golf club cover includes a pair of elongated jaws 2 and 4 which preferably are constructed from rigid support members 6 and 8. In side view, the jaws define an axis of elongation in direction shown by arrow E, FIG. 1, so as to be capable of encasing a long and narrow club head such as the putter head 10 within cavity 12 defined by jaws 2 and 4. Viewed in a direction perpendicular to the axis of elongation, the jaws exhibit a C-shaped profile with the concave sides facing each other. The C-shaped profile provides the advantageous feature that a single cover can accommodate a wide variety of elongated club head shapes. Hence, it is significant that the jaws do not very closely conform to the shape of any one particular club head. Additionally, the cavity defined by the opposing C-shaped profile jaws is generally tubular and is open at both ends 14 and 16.

Adopting the convention that the jaws have top edges 18 and bottom edges 20 disposed diametrically opposite the top edges across the tubular cavity as shown in FIG. 2, it is seen that a handle 22 is affixed to each jaw near the top edge. The shape of the handles is not critical except that the two handles are generally aligned in relation to each other in a V-shape orientation, seen to advantage in FIGS. 2 and 3. For example, the handle cross sections may be curved. Also, the shape of the rectangular profile of handle 22 seen in FIG. 1 should not be considered limiting. Any handle profile adapted to provide structural strength and leverage to operate the cover will be suitable.

A means for pivotally connecting the jaws at the top edges is provided. The novel club cover also includes a manually releasable spring means which cooperates with the pivotal connection means to urge the bottom edges of opposing jaws toward each other in a normally closed position of the cover about the head of the club. Any device well known in the art which is useful for making a pivotal connection can be used in this invention. Similarly, any well known manual spring means can be used. In the illustrated embodiment, the pivotal connection means comprises a pin 24 disposed within a cylindrical bearing formed by extensions of struts 25 and 26. The struts are respectively affixed to support members 6 and 8. Hence, the jaws are permitted to rotate toward and away from each other about the central axis of the pin. The bottom edges are urged toward each other by action of a spiral spring 28 the extended ends 29 of which are biased against the handles 22.

Additional representative pivotal connection and spring devices suitable for use in this invention are disclosed in U.S. Pat. Nos. 2,508,525; 2,705,039; 3,613,760; and 3,892,267, which are hereby incorporated by reference herein.

In one embodiment, each jaw includes a liner 3 of a soft, resilient material within the cavity 12. This soft, resilient material compresses between the club head 10 and the support member 8 when the cover is closed about the head. By resilient it is meant that the material is elastically deformable, like a sponge, i.e., it deforms under pressure and substantially returns to original shape upon release of the pressure. Because the material can conform to the shape of a rigid object with which it is placed in contact, the liner further assists the cover to firmly hold many different shaped club heads. The liner also prevents the head surface from directly touching the rigid support members 6 and 8 of the jaws. This protects the head from mar and scratch damage which might otherwise result from contact with the members. Hence, the liner should have a substantial thickness prior to deployment so as to allow the soft, resilient material to compress about the club head upon closing the jaws. Preferably, the liner should cover the bottom edges of the jaws to eliminate or at least to minimize potential scratching of the club shaft by the rigid, support members.

Any soft and resilient material well known for cushioning delicate objects can be used. Of course, the material preferably should be durable to withstand wear and tear of repeated and long term use. That is, the material should be puncture and abrasion resistant and not adversely affected by exposure to water. For example the soft, resilient material can be a polymeric foam, a deep-tufted pile or plush fabric, a thin fabric such as felt or leather over a thick layer of padding, and the like. Preferably, the overall, uncompressed thickness of the liner should be about 1/16–3/8 inch, and more preferably about 1/8–1/4 inch.

In another embodiment, the novel club cover includes an external layer 5 of a soft, resilient material on the outside of the jaws. The external layer can be of the same or different material as the liner. Although the external layer may partially have a cosmetic purpose, it also protects the cover from damage due to contact with other clubs in a golf bag while deployed on the club. In view that the protective function primarily is directed toward fending off contact with other objects, the thickness of the external layer should be at least about 1/16 inch. Optionally, the external layer of soft material can also be placed on the handles 22.

Figure 5:
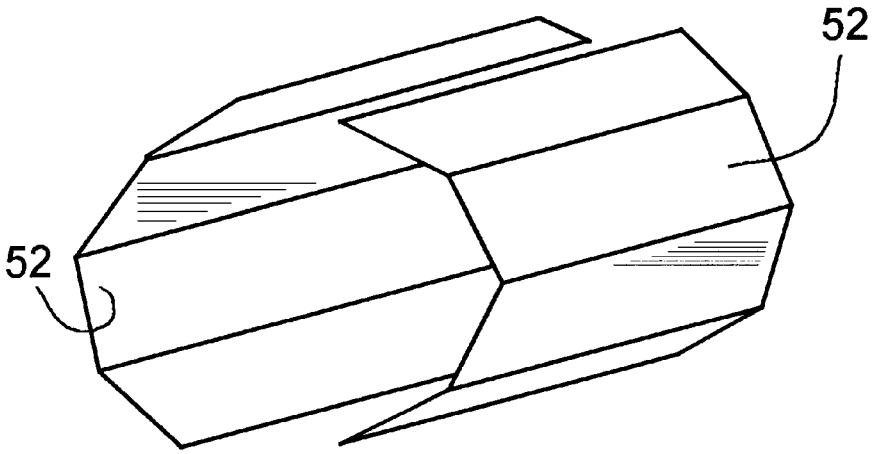
FIG. 5 is a partial perspective view of a jaw configuration of intersecting planar panels for the novel golf club cover according to this invention.

A variety of geometric configurations for the C-shaped jaws are contemplated to fall within the concept of the novel club cover. In one example, the jaws can have a smoothly curved concave profile as seen in FIG. 3. In a particular aspect, the curvature of the jaws can be circular arcs. In another example, the jaws can be comprised of a plurality of axially intersecting planar panels 52 (FIG. 5). In a particular aspect, each jaw comprises about 2 to 4 intersecting planer panels. The jaws should be slightly longer than the club head. Preferably jaw length should be at least about 5 inches and more preferably about 5–6 inches. The C-shaped curvature of the jaws in closed position without a club head inside should preferably be about 1 inch in diameter.

In initial condition, spring tension forces the bottom edges into abutting contact. The novel club cover is operated by manually squeezing the handles 22 toward each other to counteract the tension of spring 29. This causes the jaws to rotate outwardly about the axis of the pivotal connection means 24 thereby creating a wide gap between the bottom edges. Preferably this gap should be at least about 2 inches, more preferably about 2–3 inches, and most preferably about 2½ inches. While maintaining manual pressure on the handles, the cover can be easily slipped over the head of a golf club. With the club head situated centrally within the tubular cavity between the jaws, handle pressure is removed. Spring force closes the jaws about the head until the head is firmly grasped by the compressed liner of soft, resilient material, and/or the shaft is pinched between bottom edges of the cover. Preferably, the bottom edges are linear along the length of the cover. Consequently, the cover is adapted to grasp T style, L style or intermediately positioned shafts. With the novel cover thus deployed on the club head, the club can be stored in a bag with assurance that the head will be protected from damage by impact with other clubs or objects.

At time to play the club, the cover can be easily and quickly removed from the head by squeezing the handles to expand the opening between the jaws and lifting the cover away from the head. The cover can be removed before or after withdrawing the club from the bag.

Figure 4A:
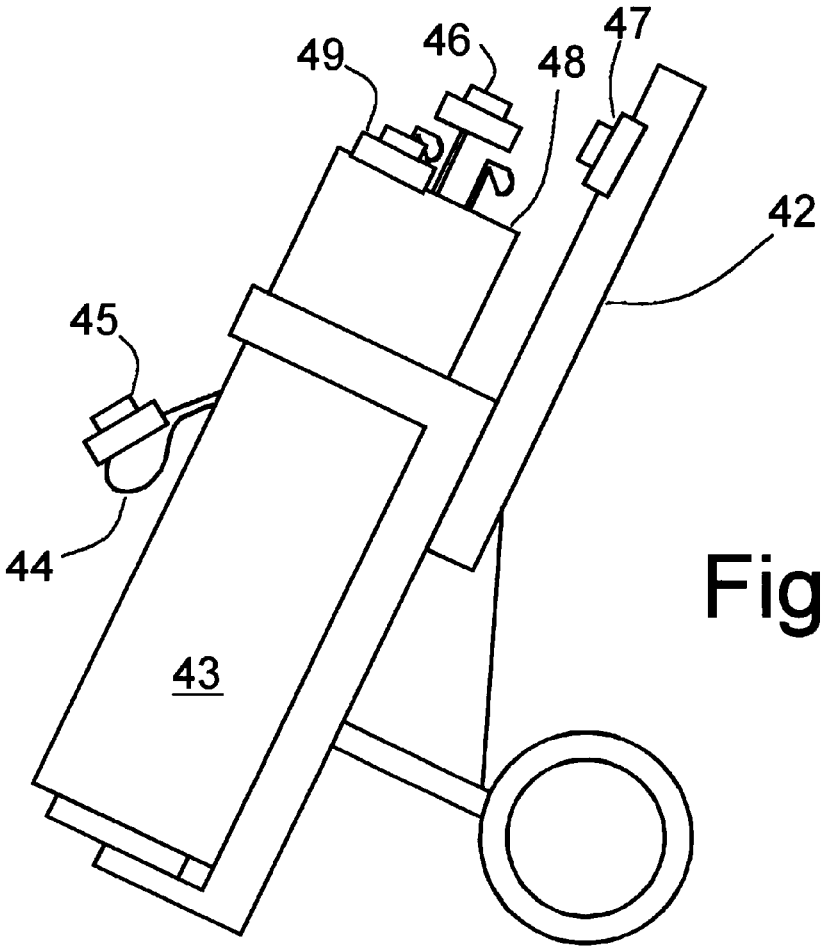
FIG. 4A is a side view showing the golf club cover of this invention in storage positions on a golf bag and manual cart.
Figure 4B:
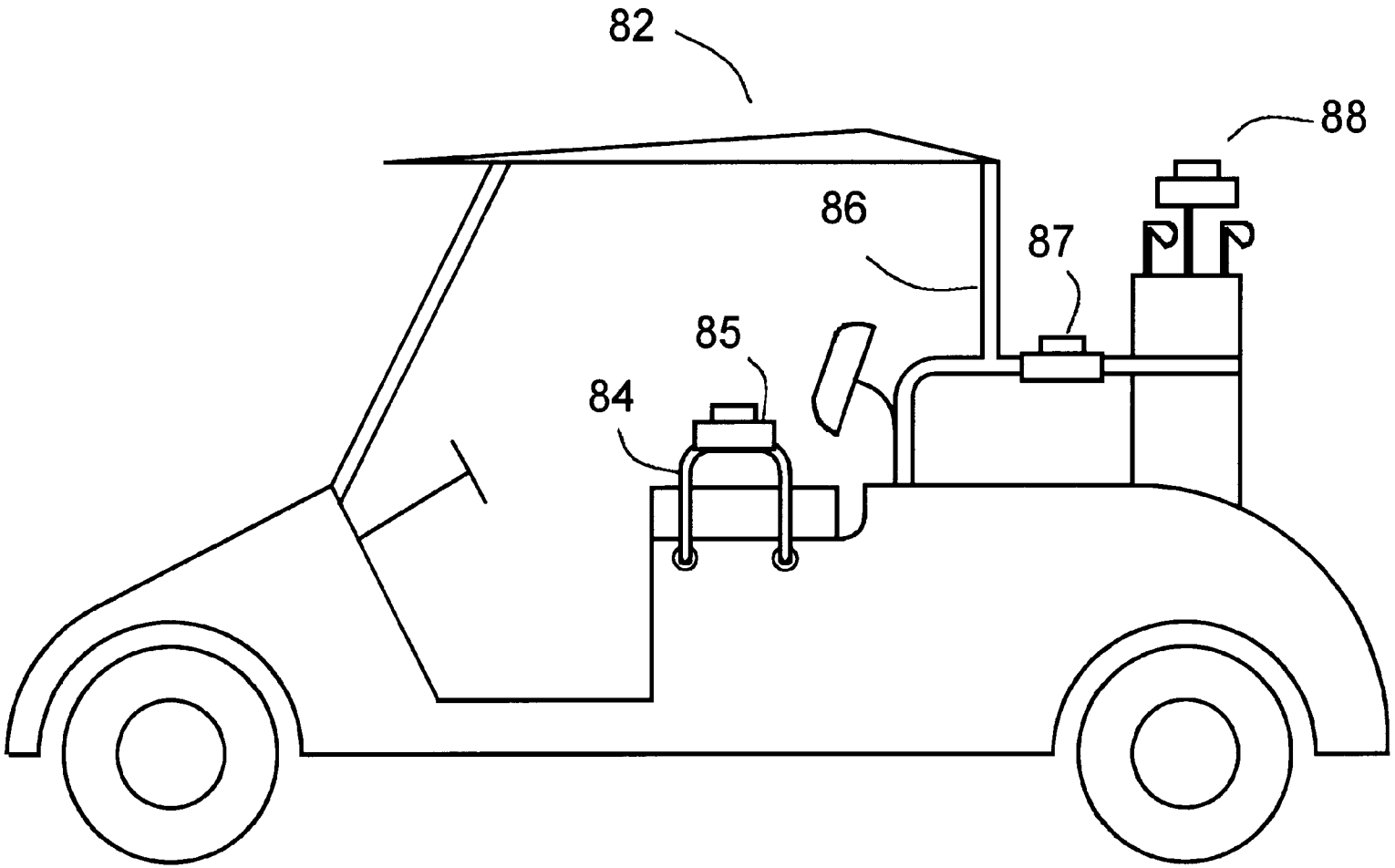
FIG. 4*b* is a side view showing the golf club cover of this invention in storage positions on a golf bag and motorized cart.

Before playing the club, the cover can be simply, rapidly and securely stored. The user again squeezes the handles to spread the jaws, and then deploys the cover on any nearby stationary tube or tab shaped object. The open ended, tubular shape of the cover renders it especially well adapted to mounting on tubular structures found on many common golf accessories. FIG. 4A shows typical alternative places to store a novel cover 46 on a manual golf cart and bag 43. For example, the cover 45, 47 and 49, can be stored on bag handle 44, bag lip, 48, or cart handle 42, respectively. Similarly FIG. 4B shows that a cover 88 can be temporarily stored at position 87 on the frame 86 or at position 85 of handle 84 of a motorized golf cart 82.

Frequently, the novel club cover can be deployed in the storage position in a single, continuous motion at the time the user removes the cover from the club. That is, as the cover is removed from the club, the user maintains handle pressure to keep the jaws spread while relocating the cover to a storage support object. Similarly, the cover can be retrieved from storage and redeployed onto the club at end of play with an economy of effort and time. Furthermore, while the club is played, the cover remains securely and prominently attached to the bag or cart without being tethered thereto by a rope. Although the cover is not secured by a tether, the likelihood that the cover will be misplaced or lost is reduced.

Although specific forms of the invention have been selected for illustration in the drawings, and the preceding description is drawn in specific terms for the purpose of describing these forms of the invention, this description is not intended to limit the scope of the invention which is defined in the claims.

What is claimed is:

1. A cover for the head of a golf club comprising a pair of elongated jaws which define an axis of elongation, each jaw having a C-shaped profile perpendicular to the axis to define an open ended, tubular cavity, a top edge, and a bottom edge diametrically across the cavity from the top edge;

means for pivotally connecting the jaws at the top edges;

a handle affixed to each jaw, which handles are aligned in relation to each other in a V-shape orientation; and manually releasable spring means for urging the bottom edges toward each other in a normally closed position of the cover about the head of the club.

2. The cover of claim 1 in which the jaws are adapted to separate at the bottom edge when the handles are manually squeezed toward each other to counteract tension of the spring.

3. The cover of claim 1 in which the jaws are adapted to grip a tubular golf cart handle for storage away from the club.

4. A cover for the head of a putter comprising a pair of elongated jaws which define an axis of elongation, each jaw having a C-shaped profile perpendicular to the axis to define an open ended, tubular cavity, a top edge, and a bottom edge diametrically across the cavity from the top edge;

means for pivotally connecting the jaws at the top edges;

a handle affixed to each jaw, which handles are aligned in relation to each other in a V-shape orientation; and manually releasable spring means for urging the bottom edges toward each other in a normally closed position of the cover about the head of the putter in which the jaws comprise a plurality of axially intersecting planar panels.

5. The cover of claim 4 in which each jaw comprises about 2 to 4 axially intersecting planar panels.

6. The cover of claim 5 in which each jaw comprises 2 axially intersecting planar panels.

7. The cover of 4 further comprising a liner of a soft, resilient material on the jaws within the cavity.

8. The cover of claim 7 comprising a casing of a soft, resilient material on the jaws outside the cavity.

9. A cover for the head of a putter comprising a pair of elongated jaws which define an axis of elongation, each jaw having a C-shaped profile perpendicular to the axis to define an open ended, tubular cavity, a top edge, and a bottom edge diametrically across the cavity from the top edge;

means for pivotally connecting the jaws at the top edges;

a handle affixed to each jaw, which handles are aligned in relation to each other in a V-shape orientation;

manually releasable spring means for urging the bottom edges toward each other in a normally closed position of the cover about the head of the putter;

a liner of a soft, resilient material on the jaws within the cavity; and a layer of a soft, resilient material on the jaws outside the cavity.

10. The cover of claim 9 further comprising a layer of soft material on the handles.

11. The cover of claim 9 in which each of the jaws defines a smoothly curving C-shaped profile.

12. The cover of claim 11 in which the C-shaped profiles are circular arcs.

13. The cover of claim 9 in which the C-shaped profile is uniform along the axis.

14. The cover of claim 13 in which the jaws are adapted to grip a tubular structure thereby mounting the cover on a tubular structure.

15. The cover of claim 14 in which the jaws are adapted to grip a handle of a golf cart.

16. A cover for the head of a golf club comprising a pair of elongated jaws which define an axis of elongation, each jaw having a C-shaped profile perpendicular to and uniform along the axis to define an open ended, tubular cavity, a top edge, and a bottom edge diametrically across the cavity from the top edge;

means for pivotally connecting the jaws at the top edges;

a handle affixed to each jaw, which handles are aligned in relation to each other in a V-shape orientation;

manually releasable spring means for urging the bottom edges toward each other in a normally closed position of the cover about the head of the club;

a liner of a soft, resilient material on the jaws within the cavity; and a layer of a soft, resilient material on the jaws outside the cavity.

17. The cover of claim 16 further comprising a layer of soft material on the handles.

* * * * *